US009370680B1

(12) United States Patent
Macaulay et al.

(10) Patent No.: US 9,370,680 B1
(45) Date of Patent: Jun. 21, 2016

(54) BODY WEIGHT SUPPORT SYSTEM FOR THERAPEUTIC AND PHYSICAL TRAINING, AND METHOD OF USE THEREOF

(75) Inventors: Malcolm R. Macaulay, Duluth, MN (US); Vernon R. Johnsen, Carlton, MN (US); Daniel J. Stein, Cloquet, MN (US)

(73) Assignee: Lightspeed Running & Rehabilitation Systems, LLC, Cloquet, MN (US)

( * ) Notice: Subject to any disclaimer, the term of this patent is extended or adjusted under 35 U.S.C. 154(b) by 694 days.

(21) Appl. No.: 13/544,448

(22) Filed: Jul. 9, 2012

Related U.S. Application Data

(60) Provisional application No. 61/551,516, filed on Oct. 26, 2011, provisional application No. 61/506,374, filed on Jul. 11, 2011.

(51) Int. Cl.

| | |
|---|---|
| ***A63B 21/00*** | (2006.01) |
| ***A63B 21/04*** | (2006.01) |
| ***A63B 22/00*** | (2006.01) |
| ***A61H 3/00*** | (2006.01) |

(52) U.S. Cl.
CPC ..... *A63B 21/00181* (2013.01); *A63B 21/0414* (2013.01)

(58) Field of Classification Search
CPC ..... A61H 3/00; A61H 3/08; A61H 2003/007; A61H 2203/0406; A63B 21/00181; A63B 21/0414; A63B 21/04; A63B 21/0407; A63B 2022/0094; A63B 23/0464
USPC ..... 482/54, 69, 143; 128/875, 882
See application file for complete search history.

(56) References Cited

U.S. PATENT DOCUMENTS

| | | | | |
|---|---|---|---|---|
| 5,176,597 | A * | 1/1993 | Bryne | 482/74 |
| 5,255,697 | A * | 10/1993 | Grauer | 135/67 |
| 6,742,523 | B2 * | 6/2004 | Dubats | 128/875 |
| 7,544,155 | B2 * | 6/2009 | Agrawal et al. | 482/69 |
| 8,480,602 | B1 * | 7/2013 | Cook | 601/35 |
| 8,608,479 | B2 * | 12/2013 | Liu | 434/255 |
| 8,663,133 | B2 * | 3/2014 | Johnson et al. | 601/23 |
| 2003/0162636 | A1 * | 8/2003 | West | 482/69 |
| 2006/0229167 | A1 * | 10/2006 | Kram et al. | 482/54 |
| 2006/0240952 | A1 * | 10/2006 | Schlosser | 482/69 |
| 2007/0281842 | A1 * | 12/2007 | Thornton et al. | 482/143 |
| 2009/0156372 | A1 * | 6/2009 | Solomon | 482/69 |

* cited by examiner

*Primary Examiner* — Oren Ginsberg
*Assistant Examiner* — Sundhara Ganesan
(74) *Attorney, Agent, or Firm* — James L. Young; Westman, Champlin & Koehler, P.A.

(57) ABSTRACT

A body weight support system for use with an exercise machine, the body weight support system comprising a frame assembly, a biasing cord connectable that is suspendable from the frame assembly, and a harness mechanism connectable to the biasing cord and wearable by a user to generate a lifting force that extends through a femoral head axis of motion of the user.

20 Claims, 7 Drawing Sheets

BODY WEIGHT SUPPORT SYSTEM FOR THERAPEUTIC AND PHYSICAL TRAINING, AND METHOD OF USE THEREOF

CROSS-REFERENCE TO RELATED APPLICATION(S)

This application claims priority to U.S. Provisional Patent Application No. 61/506,374, filed on Jul. 11, 2011; and to U.S. Provisional Patent Application No. 61/551,516, filed on Oct. 26, 2011; each entitled "BODY WEIGHT SUPPORT SYSTEM FOR THERAPEUTIC AND PHYSICAL TRAINING, AND METHOD OF USE THEREOF"; the contents of which are incorporated by reference in their entireties.

BACKGROUND

The present disclosure is directed to therapeutic and physical training systems and techniques. In particular, the present disclosure is directed to suspension systems for therapeutic and/or physical training with exercise machines, such as treadmills.

A variety of therapeutic and/or training based devices have been developed that suspend an individual in order to support a selected portion of their weight while standing or exercising. These devices claim to allow an individual to develop strength and coordination at an earlier stage of recovery while minimizing the risk of further injury. Most previous therapeutic and/or training-based unloading devices include a stationary or mobile frame that spans a treadmill over the head of the exercising individual. The lift force comes from above the individual attaching below the rib cage by a belt which relies on compression of the abdomen to keep it from sliding upward.

The problem of the belt migrating upward is sometimes lessened by having the belt anchored by straps extending either through the individuals groin region, bottom of the thighs or calf muscles. Problems with these known systems include: (1) lack of comfort, especially around the lower rib cage; (2) cumbersome frames and the need for high ceiling spaces; expensive costs, rendering the systems unaffordable for most individuals outside of a therapeutic or experimental situation; and (3) the dampening of the vertical forces provided by the systems do not match the normal vertical movements attained with walking or especially running.

A more recent unweighting system has been developed that applies air pressure to a portion of a body of an individual in a pressurized chamber. This system encloses the body portion in a chamber that is configured to accommodate movement of the body portion inside the chamber by securing a seal ring around the individual's waist and regulating the air pressure within the chamber. A common issue with this system is it is expensive and may be unaffordable for most individuals outside of a therapeutic or experimental situation. Therefore, a need exists for a comfortable and affordable integrated unweighting apparatus that can be used for therapeutic and/or training based-performance objectives.

SUMMARY

An aspect of the present disclosure is directed to a body weight support system for use with an exercise machine. The body weight support system includes a frame assembly configured to extend adjacent to the exercise machine, where the frame assembly includes a first bar configured to be positioned above a front section of the exercise machine, and second bar configured to be positioned above a rear section of the exercise machine. The first bar and the second bar are each adjustable in elevation. The body weight support system also includes a biasing cord connectable to the first bar and the second bar such that the biasing cord is suspendable between the first bar and the second bar, and a support strap suspended by the biasing cord. The body weight support system further includes an engagement strip configured to be secured to a leg apparel, where the engagement strip is further configured to engage with the support strap at multiple adjustable locations. When the support strap is engaged with the engagement strip, the suspension of the biasing cord between the front horizontal member and the rear horizontal member biases the leg apparel upward.

Another aspect of the present disclosure is directed to a body weight support system for use with an exercise machine, where the body weight support system includes a pair of front vertical posts configured to extend vertically adjacent to a front section of the exercise machine, and a pair of rear vertical posts configured to extend vertically adjacent to a rear section of the exercise machine. The body weight support system also includes a front horizontal member securable to the pair of front vertical posts and having at least one front connection mechanism, and a rear horizontal member securable to the pair of rear vertical posts and having at least one rear connection mechanism. The body weight support system further includes a pair of biasing cords connectable to the at least one front connection mechanism and to the at least one rear connection mechanism such that the biasing cords are suspendable between the front horizontal member and the rear horizontal member, and a harness mechanism connectable to the pair of biasing cords and wearable by a user to generate a lifting force that extends through a femoral head axis of motion of the user.

Another aspect of the present disclosure is directed to a method for using an exercise machine. The method includes suspending a biasing cord between a front horizontal bar and a rear horizontal bar, where the front horizontal bar is positioned above a front section of the exercise machine, and where the rear horizontal bar is positioned above a rear section of the exercise machine. The method also includes securing a support strap that is suspended from the biasing cord to an engagement strip that is connected to an outer lateral side of a first leg of a leg apparel worn by a user, generating a lifting force by the biasing cord that extends through a femoral head axis of motion of the user, and operating the exercise machine while generating the lift force.

This Summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The present disclosure is directed to a body weight support (BWS) system for use with an exercise machine, such as a treadmill. As discussed below, the BWS system includes a frame assembly and biasing cords that are configured to suspend a portion of an individual's weight. The independent action of the biasing cords gently counter balance the individual's natural weight to reduce and dampen both the vertical and lateral forces exerted on the suspended individual while standing or exercising.

In particular, the BWS system may be aligned over the greater trochanters of the individual, such that the lifting force extends through the femoral head axis of motion when the individual is standing, squatting, walking, jogging, running, or the like. This allows the individual to perform normal biomechanical movements on the exercise machine without restrictions. As such, the BWS system is suitable for use in therapeutic and physical training environments.

Figure 1:
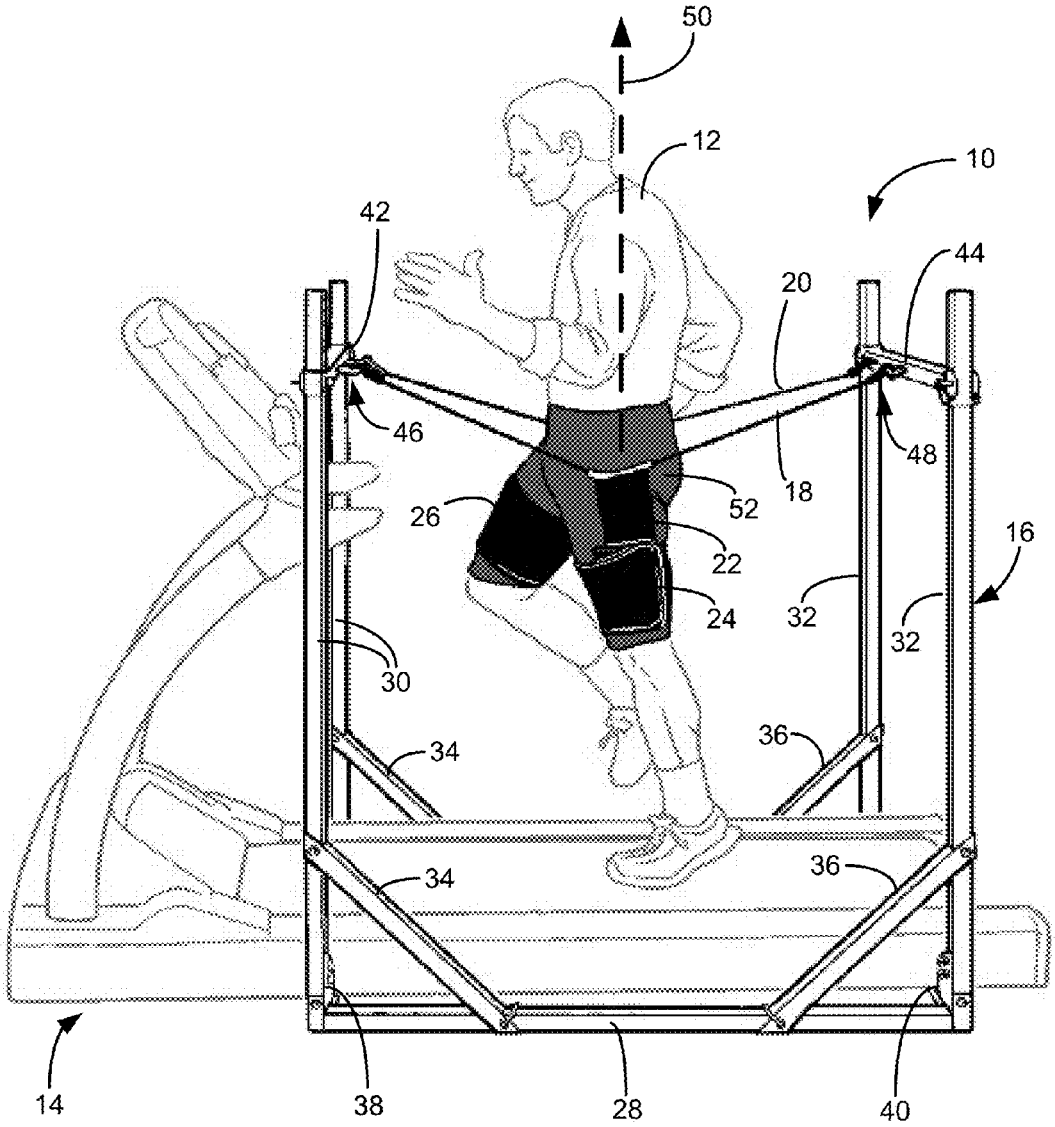
FIG. 1 is a side perspective view of a body weight support system of the present disclosure in use with a treadmill and user.

FIG. 1 shows BWS system 10 of the present disclosure in use with an individual user 12 and treadmill 14, where user 12 is supported by BWS system 10 and is running on treadmill 14. While particularly suitable for use with treadmill-based systems (e.g., treadmill 14), BWS system 10 may alternatively be used with a variety of different exercise machines in which an individual user (e.g., user 12) is oriented generally upright against the force of gravity, such as elliptical trainer machines, stepmill exercise machines, and the like.

In the shown embodiment, BWS system 10 includes frame assembly 16, biasing cords 18 and 20, support strap 22, and leg wraps 24 and 26. As discussed below, BWS system 10 also includes a second support strap (not shown in FIG. 1) corresponding to support strap 22 for use on the right side of user 12.

Frame assembly 16 includes side bars 28 (only a single side bar 28 is visible in FIG. 1), front vertical posts 30, rear vertical posts 32, front support bars 34, rear support bars 36, front support plates 38, rear support plates 40, front horizontal bar 42, and rear horizontal bar 44, each of which is desirably fabricated from one or more rigid plastic and/or metallic materials. Side bars 28 are lower horizontal side bars that extend along a floor or other suitable surface adjacent to the opposing lateral sides of treadmill 14.

Front vertical posts 30 are a pair of vertical members that extend upward from the front ends of side bars 28, and are rigidly braced to side bars 28 with front support bars 34. Rear vertical posts 32 are a pair of vertical members that extend upward from the rear ends of side bars 28, and are rigidly braced to side bars 28 with rear support bars 36. This arrangement allows front vertical posts 30 and rear vertical posts 32 to extend rigidly upward without requiring additional horizontal side bars (not shown), which may otherwise interfere with user 12 stepping onto treadmill 14. This arrangement also defines an area within front vertical posts 30 and rear vertical posts 32 in which user 12 is supported over the bed of treadmill 14.

Front horizontal bar 42 is a first upper horizontal bar that is engagable with front vertical posts 30 such that front horizontal bar 42 may be adjustably secured to front vertical posts 30 along multiple vertical increments, as discussed below. Front horizontal bar 42 includes a pair of eye bolts 46, which are connection members secured to (or integral with) front horizontal bar 42. Eye bolts 46 provide suitable locations for connecting the front ends of biasing cords 18 and 20 to front horizontal bar 42. While illustrated with a pair of eye bolts 46, BWS system 10 may alternatively include one or more different connection members for connecting biasing cords 18 and 20 to front horizontal bar 42.

Similarly, rear horizontal bar 44 is a second upper horizontal bar that is engagable with rear vertical posts 32 such that rear horizontal bar 44 may be adjustably secured to rear vertical posts 32 along multiple vertical increments, independent of front horizontal bar 42. Rear horizontal bar 44 includes a pair of eye bolts 48, which are connection members secured to (or integral with) rear horizontal bar 44. Eye bolts 48 provide suitable locations for connecting the rear ends of biasing cords 18 and 20 to rear horizontal bar 44. While illustrated with a pair of eye bolts 44, BWS system 10 may also alternatively include one or more different connection members for connecting biasing cords 18 and 20 to rear horizontal bar 44.

Biasing cords 18 and 20 are a pair of elastic cords configured to lift user 12 upwards against the force of gravity (in the direction of arrow 50), thereby supporting a portion of the weight of user 12. Biasing cords 18 and 20 may be fabricated from one or more elastic materials, such as one or more rubber materials. As shown, biasing cords 18 and 20 extend between front horizontal bar 42 and rear horizontal bar 44, on opposing sides of user 12.

Biasing cord 18 supports support straps 22, where support strap 22 may slide over biasing cord 18 between front horizontal bar 42 and rear horizontal bar 44. Support strap 22 may be secured to the left hip of user 12. As discussed below, user 12 wears shorts 52, which are desirably fitted shorts (e.g., neoprene and lycra shorts) that include engagement strips (not shown in FIG. 1) on each leg. A first of the engagement strips is secured to the outer left side of shorts 52 and is configured to engage with support strap 22 using leg wrap 24. A second of the engagement strips is secured to the outer right side of shorts 52 and is configured to engage with the second support strap using leg wrap 26. While illustrated in use with fitted shorts 52, BWS system 10 may alternatively be used with a variety of different leg apparel that are desirably properly fitted to an intended user (e.g., user 12).

The independent action of biasing cords 18 and 20 gently counter balance the natural weight of user 12, and lifts user 12 in the direction of arrow 50. This unloads a selected portion of the weight of user 12, while also dampening both vertical and lateral forces exerted on the suspended user 12 while standing or exercising on treadmill 14 (e.g., walking, jogging, running, or the like).

Figure 2:
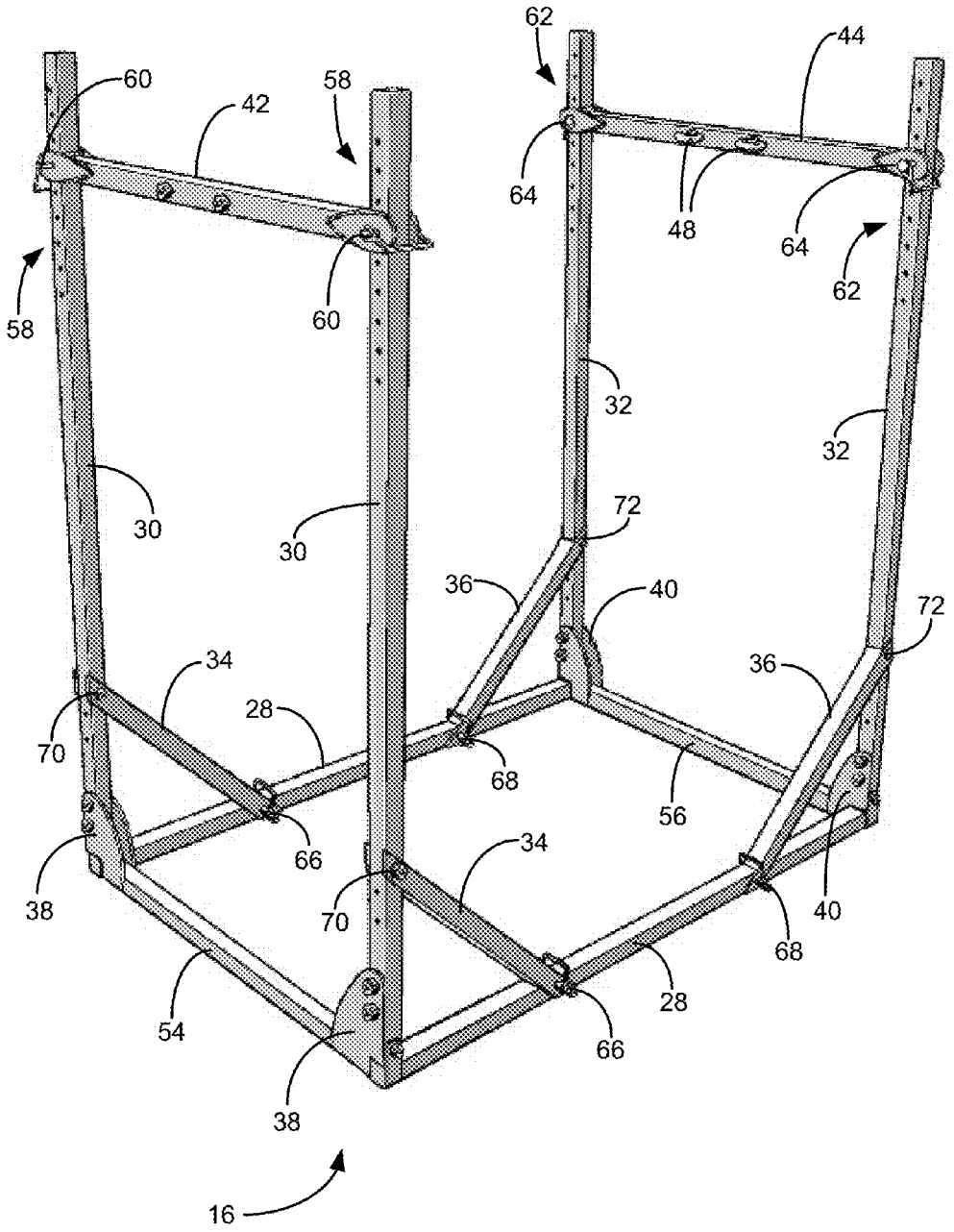
FIG. 2 is a front perspective view of a frame component of the body weight support system.

As shown in FIG. 2, frame assembly 16 also includes front base bar 54 and rear base bar 56. Front base bar 54 and rear base bar 56 are lower horizontal bars that extends along the floor or other suitable surface beneath the bed of treadmill 14, perpendicular to side bars 28. Front vertical posts 30 extend upward from the lateral ends of front base bar 54, and are rigidly braced to front base bar 54 with front support plates 38. Rear vertical posts 32 extend upward from the lateral ends of rear base bar 56, and are rigidly braced to rear base bar 56 with rear support plates 40. This arrangement provides stable, adjustable support points for BWS system 10. While illustrated with the shown features, frame assembly 16 may incorporate a variety of different designs to support front horizontal bar 42 and rear horizontal bar 44. For example, frame assembly 16 may include a single (or at least one) lower base bar corresponding to front base bar 54 and rear base bar 56 to interconnect side bars 28. Additionally, front support bars 34, rear support bars 36, front support plates 38, and rear support plates 40 may be replaced with a variety of different components to support and brace frame assembly 16.

As further shown in FIG. 2, front vertical posts 30 each include multiple openings 58 that extend in vertical arrays near the top ends of front vertical posts 30. Openings 58 provide suitable locations for locking front horizontal bar 42 at multiple adjustable elevations with slide pins 60. Correspondingly, rear vertical posts 32 each include multiple openings 62 that extend in vertical arrays near the top ends of rear vertical posts 32, which provide suitable locations for locking rear horizontal bar 44 at multiple adjustable elevations with slide pins 64. Thus, front horizontal bar 42 and rear horizontal bar 44 may be independently raised and lowered to accommodate individuals of different heights, sizes, and body types.

While the shown embodiment is configured for manual height adjustments, in an alternative embodiment, the height adjustments of front horizontal bar 42 and rear horizontal bar 44 (and any other desired component of BWS system 10) may be performed in an electronically-controlled manner. For example, front vertical posts 30 and/or rear vertical posts 32 may include controllable actuators (e.g., hydraulic-type pistons, pneumatic-type pistons, and servo motors, not shown) to respectively adjust the heights of front horizontal bar 42 and/or rear horizontal bar 44. Operation of the controllable actuators may be performed with one or more processor-based units (not shown), such as a controller of treadmill 14, a dedicated controller unit for use with BWS system 10, and/or a separate computer-based system (e.g., a personal computer, laptop computer, mobile device, personal data assistant, mobile phone, tablet computer, media player, and the like). The one or more processor-based units may communicate with BWS system 10 over one or more electrical, optical, and/or wireless communication and power lines.

The lifting force applied to user 12 in the direction of arrow 50 (shown in FIG. 1) may be adjusted by adjusting the height of front horizontal bar 42 relative to front vertical posts 30, by adjusting the height of rear horizontal bar 44 relative to rear vertical posts 32, by modifying the tension on one or both of biasing cords 18 and 20, and/or by changing the connection locations of the support straps (e.g., support straps 22) relative to fitted shorts 52. This allows a user (e.g., user 12) to select the amount of weight to be unloaded for their specific therapeutic and/or training-based performance objectives.

Figure 3:
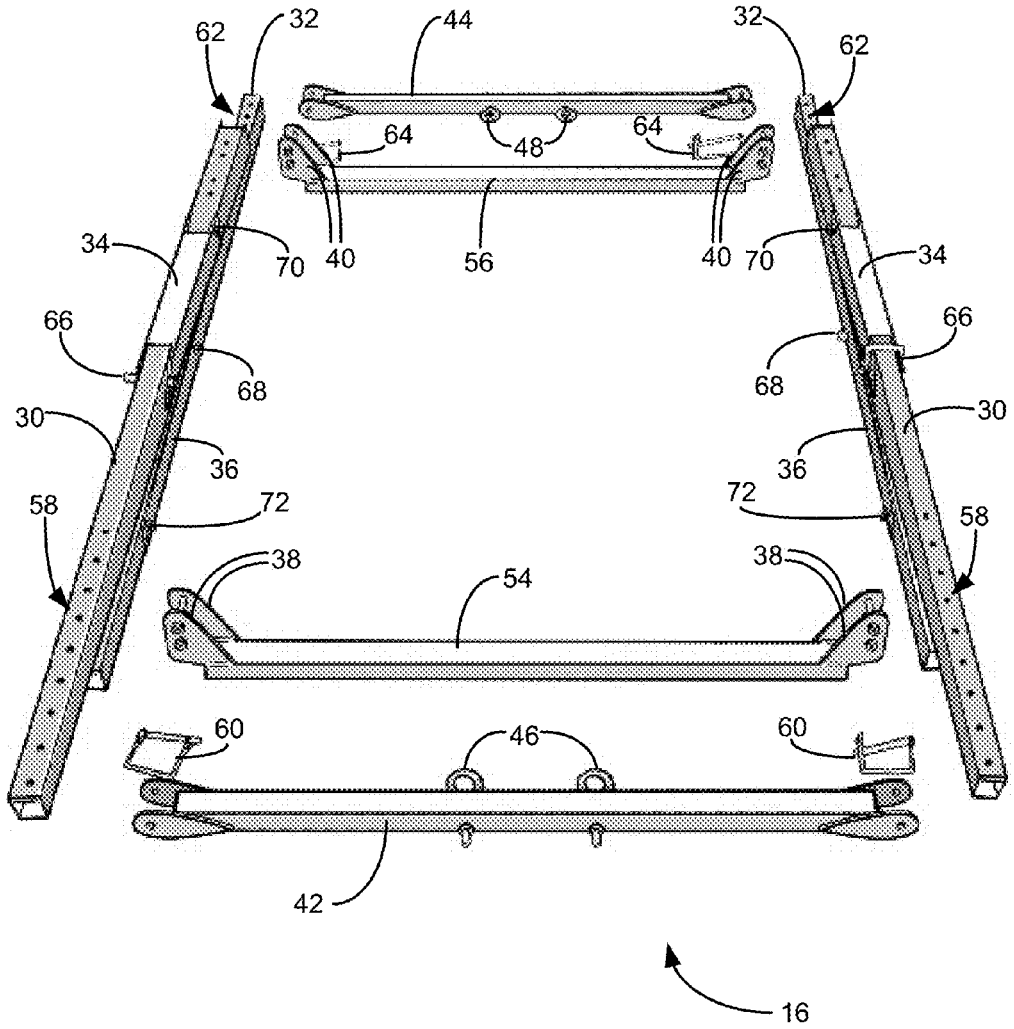
FIG. 3 is a front perspective view of the frame component in a disassembled state.

As shown in FIGS. 2 and 3 (side bars 28 omitted from FIG. 3), frame assembly 16 is readily collapsible for easy transportation, storage, and use with different exercise equipment (e.g., different treadmills). For example, frame assembly 16 also includes front slide pins 66 and rear slide pins 68. Front slide pins 66 are suitable for securing front support bars 34 to side bars 28, while also allowing front support bars 34 to be readily disassembled from side bars 28 by removing front slide pins 66. Front support bars 34 may also be pivotally secured to front vertical posts 30 with fasteners 70. When disassembled, front support bars 34 may pivot around fasteners 70 to align with front vertical posts 30 (as shown in FIG. 3) for transportation or storage.

Rear slide pins 68 are correspondingly suitable for securing rear support bars 36 to side bars 28, while also allowing rear support bars 36 to be readily disassembled from side bars 28 by removing rear slide pins 68. Rear support bars 36 may also be pivotally secured to rear vertical posts 32 with fasteners 72. When disassembled, rear support bars 36 may pivot around fasteners 72 to align with rear vertical posts 32 (as shown in FIG. 3) for transportation or storage.

Figure 4:
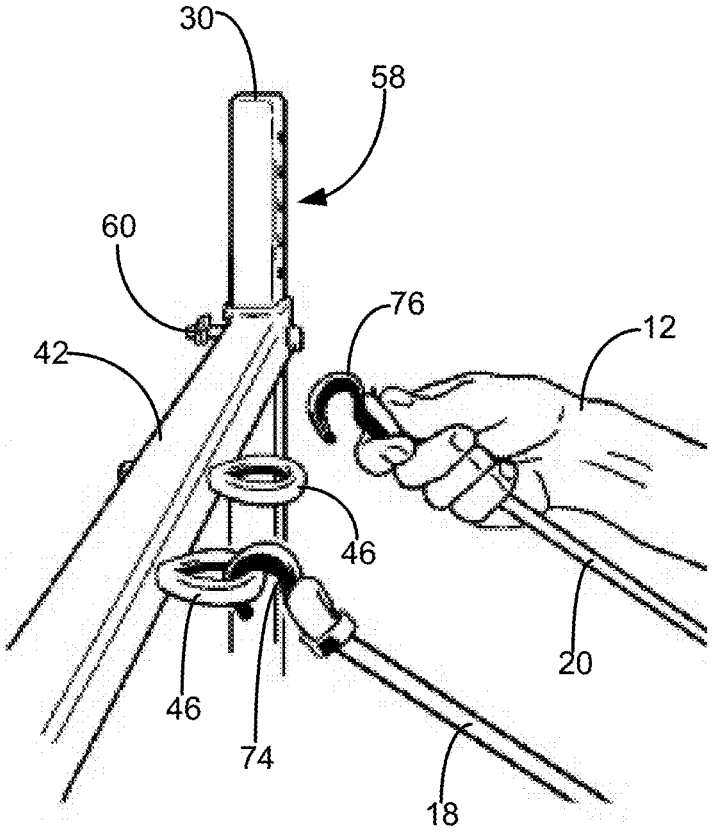
FIG. 4 is an expanded perspective view of a user attaching elastic cords of the body weight support system to front connection mechanisms of the frame component.
Figure 5:
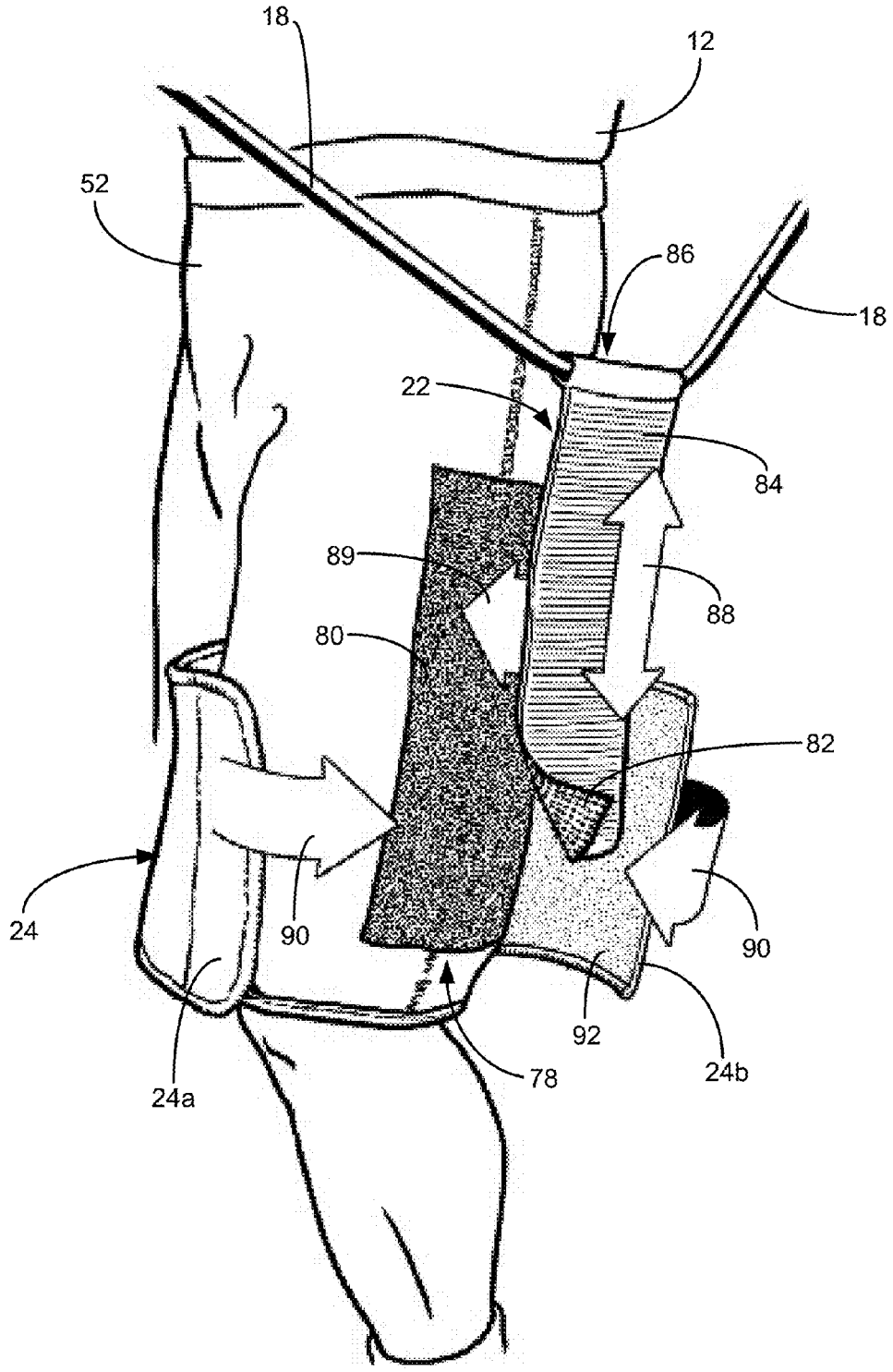
FIG. 5 is a left side expanded view of an apparel connection portion of the body weight support system in use, illustrating a technique for the user to mount the body weight support system.
Figure 6:
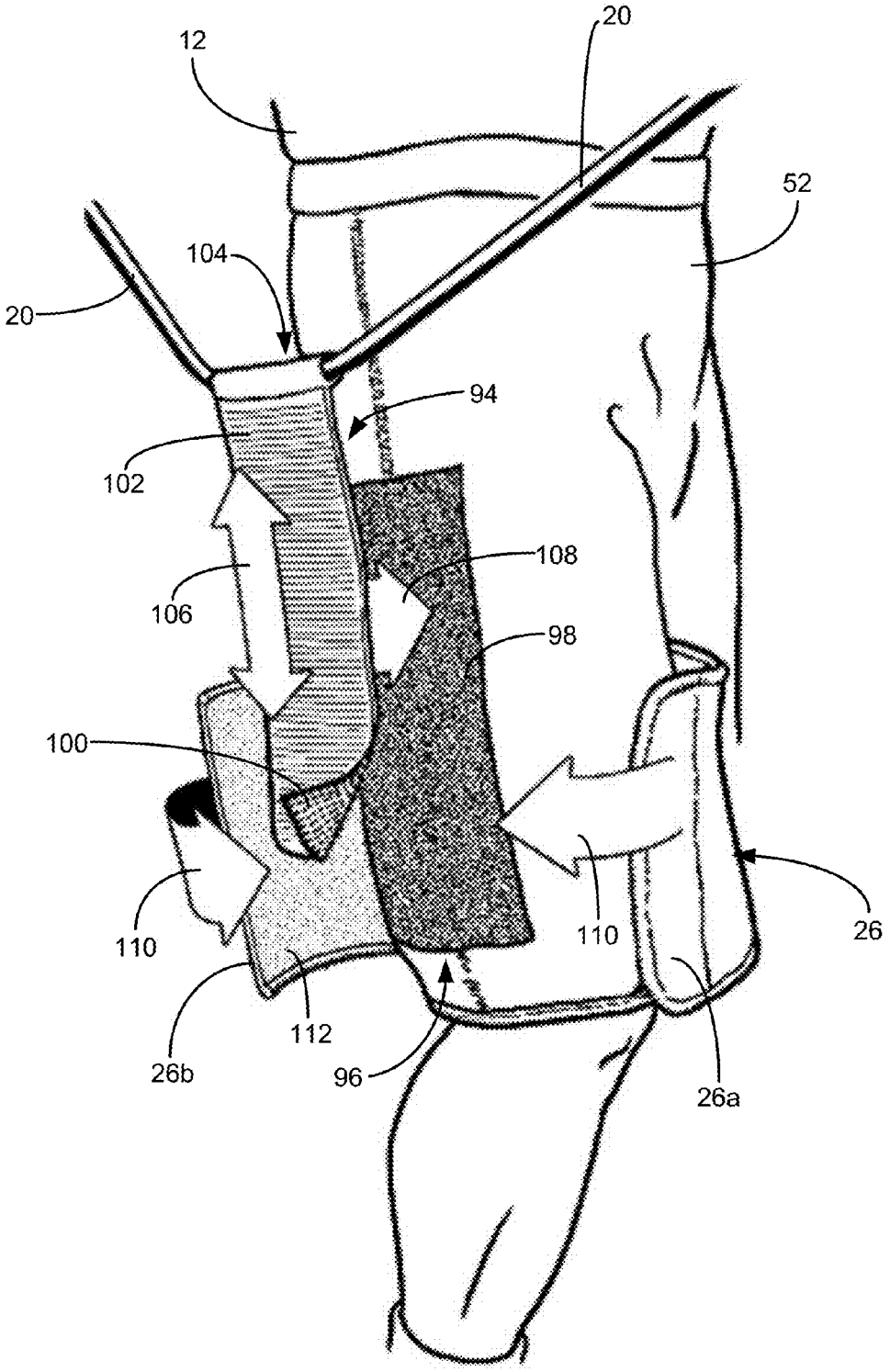
FIG. 6 is a right side expanded view of the apparel connection portion of the body weight support system in use, further illustrating the technique for the user to mount the body weight support system.

FIGS. 4-6 illustrate a suitable technique for securing BWS system 10 to a user (e.g., user 12 wearing fitted shorts 52) for use with an exercise machine (e.g., treadmill 14). As shown in FIG. 4, after stepping onto treadmill 12 and between biasing cords 18 and 20 (as illustrated in FIG. 1), user 12 may connect one or both of biasing cords 18 and 20 to frame assembly 16. For example, in one embodiment, biasing cord 18 may include hook 74 on each opposing end for attachment to eye bolts 46 and 48, respectively. Similarly, biasing cord 20 may include hook 76 on each opposing end for attachment to eye bolts 46 and 48, respectively.

In this embodiment, user 12 may connect hooks 74 and 76 to eye bolts 46 and 48. This suspends biasing cords 18 and 20 between front horizontal bar 42 and rear horizontal bar 44. In alternative embodiments, biasing cords 18 and 20 may be connected to frame assembly 16 prior to user 12 stepping onto treadmill 14. In this case, user 12 may merely lift one or both of biasing cords 18 and 20 to slide between them to provide the arrangement shown in FIG. 1.

As shown in FIG. 5, user 12 may then attach support straps 22 to fitted shorts 52. As shown, shorts 52 (or other leg apparel) include engagement strip 78 secured to the outer left leg. Engagement strip 78 may be secured to shorts 52 in a variety of manners, such as being sewn to the outer left leg of shorts 52 (e.g., at the left side seam of shorts 52). This allows BWS system 10 to be used with fitted leg apparel commonly worn by user 12, thereby allowing normal walking or running mechanics when used in conjunction with treadmill 14. As such, BWS system 10 is comfortable to wear, and may connect to the individual's body in a secure manner.

Engagement strip 78 desirably extends longitudinally along the outer left leg of shorts 52 to provide multiple connection points along the left leg of shorts 52. Engagement strip 78 includes strip surface 80, which is configured to mechanically lock (e.g., interlock) with a reciprocating inner surface 82 of support strap 22. In one example of the mechanical lock, strip surface 80 may include loop fasteners, and inner surface 82 may include hook fasteners (or vice versa) to provide a hook-and-loop fastener arrangement, such as the hook-and-loop fastener commercially available under the trademark "VELCRO" from Velcro USA, Inc. of Manchester, N.H. Alternatively, in a second example of the mechanical lock, strip surface 80 and inner surface 82 may include lockable features, such as the lockable features commercially available under the trademark "DUAL LOCK" from 3M Company of Maplewood, Minn.

The opposing outer surface 84 of support strap 22 may include a surface topography, such as horizontal ribs for mechanical engagement with leg wrap 24. Support strap 22 also includes channel 86 through which biasing cord 18 extends, as shown. Channel 86 allows support strap 22 to slide along biasing cord 18 between front horizontal bar 42 and rear horizontal bar 44 for freedom of movement.

During use, user 12 may adjust the height of support strap 22 relative to engagement strip 78, as illustrated by arrow 88, until a desired height is attained. User 12 may then press support strap 22 against engagement strip 78 to mechanically lock strip surface 80 to inner surface 82, as illustrated by arrow 89. User 12 may then extend leg wrap 24 around the left leg of shorts 52 and the engaged support strap 22/engagement strip 78, as illustrated by arrows 90. User 12 may then secure the ends of leg wrap 24 (referred to as ends 24*a* and 24*b*) together, such as with a hook-and-loop type engagement.

Leg wrap 24 may be fabricated from one or more flexible and/or elastic materials, and may include inner surface 92 configured to mechanically engage with opposing surface 84 of support strap 22 (e.g., via a hook-and-loop type engagement or lockable features). This further locks support strap 22 to engagement strip 78 and shorts 52, preventing support strap 22 from moving vertically relative to shorts 52.

As shown in FIG. 6, BWS system 10 also includes support strap 94 and engagement strip 96, which may function in the same manner as support strap 22 and engagement strip 78 for securing the right leg of shorts 52 to BWS system 10. Shorts 52 (or other leg apparel) also include engagement strip 96 secured to the outer right leg, where engagement strip 96 may be secured to shorts 52 in a variety of manners, such as being sewn to the outer right leg of shorts 52 (e.g., at the right side seam of shorts 52).

Engagement strip 96 desirably extends longitudinally along the outer right leg of shorts 52 to provide multiple connection points along the right leg of shorts 52. Engagement strip 96 includes strip surface 98, which is configured to mechanically lock (e.g., interlock) with a reciprocating inner surface 100 of support strap 94. In one example of the mechanical lock, strip surface 98 may also include loop fasteners, and inner surface 100 may include hook fasteners (or vice versa) to provide a hook-and-loop fastener arrangement, such as the hook-and-loop fastener commercially available under the trademark "VELCRO" from Velcro USA, Inc. of Manchester, N.H. Alternatively, in a second example of the mechanical lock, strip surface 98 and inner surface 100 may include lockable features, such as the lockable features commercially available under the trademark "DUAL LOCK" from 3M Company of Maplewood, Minn.

The opposing outer surface 102 of support strap 94 may also include a surface topography, such as horizontal ribs for mechanical engagement with leg wrap 26. Support strap 94 also includes channel 104 through which biasing cord 20 extends, as shown. Channel 104 allows support strap 94 to slide along biasing cord 20 between front horizontal bar 42 and rear horizontal bar 44 for freedom of movement.

During use, user 12 may adjust the height of support strap 94 relative to engagement strip 96, as illustrated by arrow 106, until a desired height is attained. User 12 may then press support strap 94 against engagement strip 96 to mechanically lock strip surface 98 to inner surface 100, as illustrated by arrow 108. User 12 may then extend leg wrap 26 around the right leg of shorts 52 and the engaged support strap 94/engagement strip 96, as illustrated by arrows 110. User 12 may then secure the ends of leg wrap 26 (referred to as ends 26*a* and 26*b*) together, such as with a hook-and-loop fastener arrangement.

Leg wrap 26 may also be fabricated from one or more flexible and/or elastic materials, and may include inner surface 112 configured to mechanically engage with opposing surface 102 of support strap 94 (e.g., via a hook-and-loop type engagement or lockable features). This further locks support strap 94 to engagement strip 96 and shorts 52, preventing support strap 96 from moving vertically relative to shorts 52.

The above-discussed steps for installing BWS system 10 may alternatively be performed in different orders. For example, user 12 may initially secure support strips 22 and 94 to shorts 52 in either order (as illustrated in FIGS. 5 and 6), and then hook biasing cords 18 and 20 to frame assembly 16 (as illustrated in FIG. 4). While leg wraps 24 and 26 are secured around shorts 52 (e.g., as shown in FIG. 1), leg wraps 24 and 26 effectively prevent shorts 52 from being lift upward by the lifting force of biasing cords 18 and 20. This maintains the comfort and freedom of movement for user 12 while user 12 stands or exercises on treadmill 14.

Accordingly, support straps 22 and 94, engagement strips 78 and 96, and leg wraps 24 and 26 may collectively function as a harness mechanism that is wearable by user 12 via shorts 52, which generates a lifting force that extends through a femoral head axis of motion of user 12. User 12 may also adjust one or more of the height of front horizontal bar 42 relative to front vertical posts 30, the height of rear horizontal bar 44 relative to rear vertical posts 32, the tension on one or both of biasing cords 18 and 20, and the connection heights between support straps 22 and 94 with fitted shorts 52 to attain the desired amount of weight to be unloaded for the specific therapeutic and/or training-based performance objectives.

Furthermore, the relative tensions in biasing cords 18 and 20 may be adjusted to support specific portions of the weight of user 12 based on specific needs and goals. For example, in a situation in which the left foot or leg of user 12 is injured, user 12 may apply a greater lifting force on the left side relative to the right side to reduce the impact applied the left foot or leg while running on treadmill 14.

After being mounted to BWS system 10, user 12 is positioned above the bed of treadmill 14 within the area defined by front vertical posts 30 and rear vertical posts 32. This provides a stable upward lifting force in the direction of arrow 50 (shown in FIG. 1) to partially suspend user 12 above treadmill 14 in a manner that reduces and dampens both vertical and lateral forces that are exerted on user 12 while standing or exercising.

While undertaking physical activities (e.g., running), the connection points of BWS system 10 to user 12 allows the lifting force to be placed through the axis of rotation of the legs of user 12 at the hip joint while walking, jogging, or running on treadmill 14. In particular, support straps 22 and 94 are aligned over the greater trochanters of user 12, such that the lifting force extends through the femoral head axis of motion of user 12, regardless of whether user 12 is standing, squatting, walking, jogging, or running. This provides a more efficient and effective lower body position by promoting the placement of the greater trochanters of user 12 at or near an optimum balance position.

This creates freedom of leg biomechanics under the hips and upper body of user 12, and also allows the legs of user 12 to turnover at a faster rate, promoting an over-speed training effect, each of which may lead to improved performances by lowering times for runners at a variety of distances. Additionally, the optimum balance position is suitable for training the body to recognize this position through muscle memory, and therefore an individual may work to return to this position when not using BWS system 10.

After use, user 12 may remove BWS system 10 by reversing the above-discussed installation steps. For example, user 12 may unwrap leg wraps 24 and 26, and unlock support straps 22 and 94 from engagement strips 78 and 96, respectively. User 12 may also unhook one or both of biasing cords 18 and 20 from frame assembly 16, and step off of treadmill 14. If desired, frame assembly 16 may also be readily disassembled and folded down for convenient storage or transportation.

Accordingly, BWS system 10 may be interchangeably used with a variety of currently-existing exercise machines (e.g., fits around most existing treadmill decks), providing a low-cost, easy-to-assemble, and comfortable system. Frame assembly 16 of BWS system 10 may be adjusted to accommodate the lifting force needed for individuals of different heights, sizes, and body types, to securely and comfortably connect the individuals. Therefore, BWS system 10 may be used in numerous therapeutic and physical training environments, allowing individuals to recover from injuries, soreness, and/or fatigue, and thus, return to normal exercises and/or training routines in shorter amounts of time.

Figure 7:
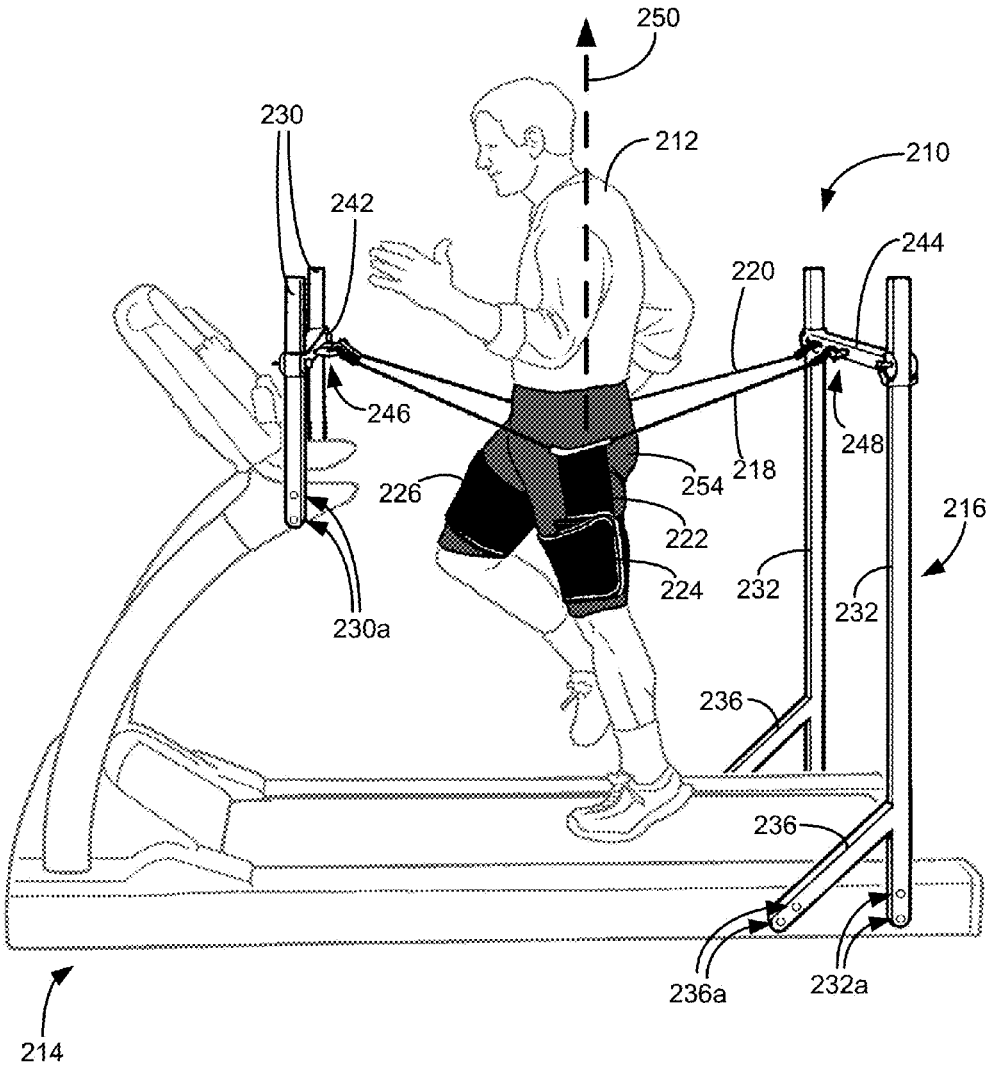
FIG. 7 is a side perspective view of an alternative body weight support system of the present disclosure in use with a treadmill and user, where the alternative body weight support system is connected to the treadmill.

FIG. 7 shows BWS system 210 of the present disclosure in use with individual user 212 and treadmill 214, where user 212 is supported by BWS system 210 and is running on treadmill 214. BWS system 210 is an alternative to BWS system 10 (shown in FIGS. 1-6) that functions in the same manner, where corresponding reference numbers are increased by "100" from those of BWS system 10. As shown in FIG. 7, BWS system 210 is connected to and supported by treadmill 214 (or other suitable exercise machine).

In comparison to frame assembly 16 (shown in FIGS. 1-3), frame assembly 216 of BWS system 210 includes front vertical posts 230, vertical posts 232, and rear support bars 236 (in lieu of vertical posts 30, vertical posts 32, and rear support bars 36), where the components corresponding to side bars 28, front support bars 34, front support plates 38, rear support plates 40 are omitted. In alternative embodiments, one or more components corresponding to side bars 28, front support bars 34, front support plates 38, and support plates 40 may be included. Furthermore, BWS system 210 may include additional support components (not shown) configured to reinforce and strengthen the connection between frame assembly 216 and treadmill 214.

As shown, vertical posts 230, vertical posts 232, and rear support bars 236 are connected to treadmill 214 with fasteners 230*a*, 232*a*, and 236*a*, respectively. This securely connects frame assembly 216 to treadmill 214, allowing BWS system 210 to function in the same manner as discussed above for BWS system 10. While particularly suitable for use with treadmill-based systems (e.g., treadmill 214), BWS system 210 may also alternatively be connected to a variety of different exercise machines in which an individual user (e.g., user 212) is oriented generally upright against the force of gravity, such as elliptical trainer machines, stepmill exercise machines, and the like.

In the shown example, BWS system 210 may be disconnected from treadmill 214 by removing fasteners 230*a*, 232*a*, and 236*a*, and disassembling frame assembly 216 in a similar manner to that discussed above for frame assembly 16. This allows BWS system 210 to be interchangeably used with a variety of exercise machines that have reciprocating connection components and/or mechanisms configured to mount frame assembly 216. This also provides a low-cost, easy-to-assemble, and comfortable system.

Alternatively, vertical posts 230, vertical posts 232, and rear support bars 236 may be fixedly secured to, or integrally formed with, treadmill 214 (or other similar exercise machine). For example, vertical posts 230, vertical posts 232, and/or rear support bars 236 may be integrally formed with one or more housing components of treadmill 214. This allows BWS system 210 to be customized to fit particular exercise machines.

In either embodiment, frame assembly 216 of BWS system 210 may be adjusted (manually and/or in an electronically-controlled manner, as discussed above) to accommodate the lifting force needed for individuals of different heights, sizes, and body types, to securely and comfortably connect the individuals. Therefore, BWS system 210 may also be used in numerous therapeutic and physical training environments, allowing individuals to recover from injuries, soreness, and/or fatigue, and thus, return to normal exercises and/or training routines in shorter amounts of time.

Although the present disclosure has been described with reference to several embodiments, workers skilled in the art will recognize that changes may be made in form and detail without departing from the spirit and scope of the disclosure.

The invention claimed is:

1. A body weight support system for use with an exercise machine, the body weight support system comprising:

a frame assembly configured to extend adjacent to the exercise machine, the frame assembly comprising:

a first bar configured to be positioned above a front section of the exercise machine, the first bar being adjustable in elevation; and a second bar configured to be positioned above a rear section of the exercise machine, the second bar being adjustable in elevation;

a biasing cord connectable to the first bar and the second bar such that the biasing cord is suspendable between the first bar and the second bar;

a support strap suspended by the biasing cord;

a leg apparel wearable by a user; and an engagement strip secured to the leg apparel, and configured to engage with the support strap at multiple adjustable locations, wherein, when the support strap is engaged with the engagement strip, the support strap is substantially aligned with a greater trochantor of a first leg of the user wearing the leg apparel, and the suspension of the biasing cord between the front horizontal member and the rear horizontal member biases the leg apparel upward to generate a lifting force that extends through a femoral head axis of motion of the user.

2. The body weight support system of claim 1, wherein the frame assembly further comprises:

a pair of front vertical posts positioned adjacent to the front section of the exercise machine, the front vertical posts being configured to support the first bar at different vertical locations along the front vertical posts; and a pair of rear vertical posts positioned adjacent to the rear section of the exercise machine, the rear vertical posts being configured to support the second bar at different vertical locations along the rear vertical posts.

3. The body weight support system of claim 2, wherein the frame assembly further comprises:

a first lateral base bar configured to interconnect one of the pair of front vertical posts and one of the pair of rear vertical posts;

a second lateral base bar configured to interconnect a second of the pair of front vertical posts and a second of the pair of rear vertical posts; and at least one base bar configured to extend below the exercise machine, and further configured to interconnect the first lateral base bar and the second lateral base bar.

4. The body weight support system of claim 2, wherein the pair of front vertical posts and the pair of rear vertical posts are connected to the exercise machine.

5. The body weight support system of claim 1, and further comprising a leg wrap configured to extend around the engaged support strap and engagement strip at the user's first leg.

6. The body weight support system of claim 1, wherein the engagement strip is configured to engage with the support strap at the multiple adjustable locations with a hook-and-loop fastener arrangement.

7. The body weight support system of claim 1, and further comprising:

a second biasing cord connectable to the first bar and the second bar such that the second biasing cord is suspended between the first bar and the second bar;

a second support strap suspended by the second biasing cord; and a second engagement strip secured to the leg apparel, the second engagement strip being further configured to engage with the second support strap at multiple adjustable locations, wherein, when the second support strap is engaged with the second engagement strip, the second support strap is substantially aligned with a greater trochantor of a second leg of the user, and the suspension of the second biasing cord between the front horizontal member and the rear horizontal member biases the leg apparel upward to further generate the lifting force that extends through the femoral head axis of motion for the user.

8. The body weight support system of claim 7, and further comprising:

a first leg wrap configured to extend around a first leg of the leg apparel and the engaged support strap and engagement strip; and a second leg wrap configured to extend around a second leg of the leg apparel and the engaged second support strap and second engagement strip.

9. A body weight support system for use with an exercise machine, the body weight support system comprising:

a pair of front vertical posts configured to extend vertically adjacent to a front section of the exercise machine;

a pair of rear vertical posts configured to extend vertically adjacent to a rear section of the exercise machine;

a front horizontal member securable to the pair of front vertical posts, the front horizontal member comprising at least one front connection mechanism;

a rear horizontal member securable to the pair of rear vertical posts, the rear horizontal member comprising at least one rear connection mechanism;

a pair of biasing cords connectable to the at least one front connection mechanism and to the at least one rear connection mechanism such that the biasing cords are suspendable between the front horizontal member and the rear horizontal member;

a pair of support straps suspendable from the pair of biasing cords;

a leg apparel wearable by a user an having opposing outer lateral sides; and a pair of engagement strips secured to the opposing outer lateral sides of the leg apparel, wherein each engagement strip is configured to engage one of the support straps such that the engaged support strap is substantially aligned with a greater trochantor of a leg of the user wearing the leg apparel;

wherein the suspension of the biasing cords between the front horizontal member and the rear horizontal member biases the leg apparel upward to generate a lifting force that extend through a femoral head axis of motion of the user.

10. The body weight support system of claim 9, and further comprising a pair of leg wraps each extending around one of the engaged support straps and engagement strip.

11. The body weight support system of claim 9, wherein the leg apparel comprises fitted shorts.

12. The body weight support system of claim 9, wherein the engagement strips are configured to engage the support straps with hook-and-loop fastener arrangements.

13. The body weight support system of claim 9, wherein the front horizontal member is securable to the pair of front vertical posts at multiple elevations along the front vertical posts, and wherein the rear horizontal member is securable to the pair of rear vertical posts at multiple elevations along the rear vertical posts.

14. The body weight support system of claim 9, wherein the at least one front connection mechanism comprises a pair of front eye bolts, wherein the at least one rear connection mechanism comprises a pair of rear eye bolts, and wherein the pair of biasing cords are removably connectable to the pair of front eye bolts and to the pair of rear eye bolts.

15. A method for using an exercise machine, the method comprising:

suspending a first biasing cord and a second biasing cord each between a front horizontal bar and a rear horizontal bar, wherein the front horizontal bar is positioned above a front section of the exercise machine, and wherein the rear horizontal bar is positioned above a rear section of the exercise machine;

securing a first support strap that is suspended from the first biasing cord to a first engagement strip that is connected to a first outer lateral side of a leg apparel worn by a user such that the first support strap is substantially aligned with a greater trochantor of a first leg of the user;

securing a second support strap that is suspended from the second biasing cord to a second engagement strip that is connected to a second outer lateral side the leg apparel such that the second support strap is substantially aligned with a greater trochantor of a second leg of the user;

generating a lifting force by the biasing cord that extends through a femoral head axis of motion of the user, and operating the exercise machine while generating the lift force.

16. The method of claim 15, and further comprising wrapping a leg wrap around the leg apparel at the user's first leg, and the secured support strap and engagement strip.

17. The method of claim 15, wherein the leg apparel comprises fitted shorts.

18. The method of claim 15, wherein the lifting force generated by the first biasing cord and the second lifting force generated by the second biasing cord are different in magnitude.

19. The method of claim 15, and further comprising adjusting a height of at least one of the front horizontal bar and the rear horizontal bar.

20. The method of claim 15, wherein securing the first support strap to the first engagement strip comprises mechanically locking a first surface of the first support strap with a second surface of the first engagement strip.

* * * * *